United States Patent [19]

Pane, Jr. et al.

[11] Patent Number: 4,946,105

[45] Date of Patent: Aug. 7, 1990

[54] FUEL NOZZLE FOR GAS TURBINE ENGINE

[75] Inventors: Francis C. Pane, Jr., South Windsor; James A. Dierberger, Hebron, both of Conn.

[73] Assignee: United Technologies Corporation, Hartford, Conn.

[21] Appl. No.: 180,749

[22] Filed: Apr. 12, 1988

[51] Int. Cl.[5] ..... B05B 7/06

[52] U.S. Cl. ..... 239/590.3; 239/398; 239/403; 239/422; 239/424

[58] Field of Search ..... 239/104, 533.3, 533.9, 239/520, 403–406, 467, 474, 416.4, 416.5, 424, 425, 425.5, 423, 590.3

[56] References Cited

U.S. PATENT DOCUMENTS

| | | | |
|---|---|---|---|
| 3,215,351 | 11/1965 | Briggs | 239/424 X |
| 3,663,153 | 5/1972 | Bagge et al. | 239/416.4 X |
| 3,684,186 | 8/1972 | Helmrich | 239/400 |
| 3,741,484 | 6/1973 | Cresswell | 239/424 |
| 4,014,961 | 3/1977 | Popou | 239/432 X |
| 4,188,782 | 2/1980 | Smith et al. | 60/733 |
| 4,221,339 | 9/1980 | Yoshikawa | 239/403 X |
| 4,343,434 | 8/1982 | Haruch | 239/467 X |
| 4,406,404 | 9/1983 | Horino et al. | 239/406 X |
| 4,575,325 | 3/1986 | Duerig et al. | 239/424 |
| 4,584,834 | 4/1986 | Koshoffer et al. | 239/403 X |
| 4,600,151 | 7/1986 | Bradley | 239/406 X |
| 4,609,150 | 9/1986 | Pane, Jr. et al. | 239/397.5 |

FOREIGN PATENT DOCUMENTS 2084903 4/1982 United Kingdom .

*Primary Examiner*—Robert J. Oberleitner
*Assistant Examiner*—Kevin P. Weldon
*Attorney, Agent, or Firm*—Edward L. Kochey, Jr.

[57] ABSTRACT

Fuel nozzle 10 has fuel delivery through circumferentially spaced orifices 34 impinging on baffle 40. Fuel flows through a restricted annulus 42 to an expansion volume 50 and thence through a restricted frusto conical annulus 52 to discharge 16. The baffle, restriction and expansion spreads the discrete flows through each orifice to obtain uniform circumferential expansion.

7 Claims, 2 Drawing Sheets

FUEL NOZZLE FOR GAS TURBINE ENGINE

TECHNICAL FIELD

The invention relates to gas turbine engines and in particular to fuel nozzles for combustor main burners.

BACKGROUND OF THE INVENTION

Fuel nozzles are used in combustors of gas turbines engines to atomize fuel for combustion purposes. One known method of atomization involves filming the fuel. The fuel is swirled generating a thin film near the discharge with some atomizing as the fuel is discharged, but most occurring because of the interface with high velocity air.

U.S. Pat. No. 4,609,150 issued to Pane et al shows a fuel nozzle swirling fuel and air for combustion. A plurality of circumferentially spaced orifices deliver fuel in a swirling manner to an annular chamber. The annular chamber supplies a frusto conical annular flow path of decreasing radius to an annular discharge. Swirling air atomizes the filmed fuel and serves as combustion supporting air.

Uniform mixing of fuel and air around the periphery of the nozzle is important to avoid local smoking as well as hot or cold streaks in the gaseous effluent and it follows that uniform delivery of fuel around the periphery is important.

The plurality of orifices described in U.S. Pat. No. 4,609,150 produces a plurality of concentrated flow areas within the fuel stream. Possible plugging of the orifices dictates a minimum orifice size. Also, the smaller the size of an orifice the greater the variation of its flow characteristic with variations in diameter caused by manufacturing tolerances. Accordingly, a very large number of small orifices cannot be used. The number of orifices which can be used is therefore limited and the spacing between the orifices is greater than would be desired for uniform distribution purposes.

The use of an annular restriction alone to distribute the flow suffers from significant maldistribution with eccentricity of the components forming the annulus.

SUMMARY OF THE INVENTION

Distribution of fuel in a nozzle is improved by first establishing a plurality of distributed flow zones by the use of orifices. The orifice discharge passes into an annular chamber where it impinges on an outwardly facing baffle directing the flow to a restricted annulus. An expansion downstream of the restricted annulus receives the fuel and delivers it through an increasingly restricted frustro conical annulus to discharge.

DESCRIPTION OF THE PREFERRED EMBODIMENT

Figure 1:
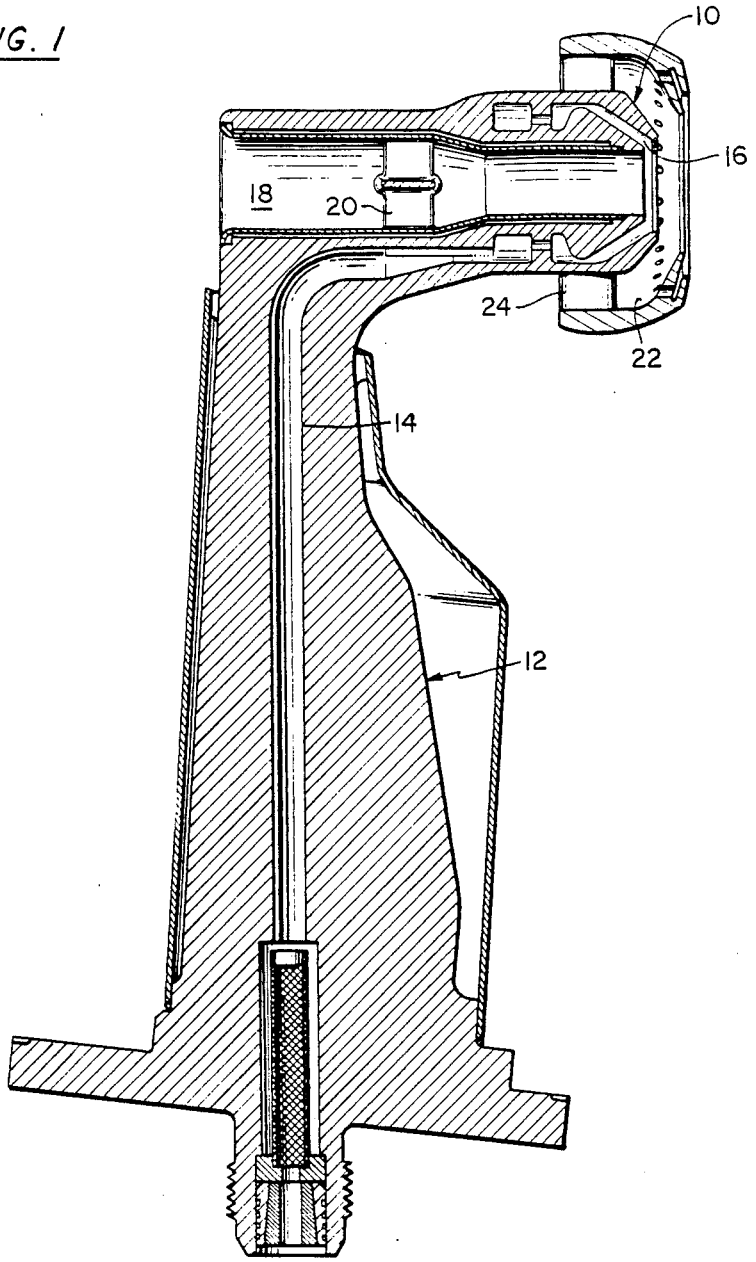
FIG. 1 is a sectional view of a fuel nozzle.

Fuel nozzle 10 is located on a support 12 which includes a fuel delivery passage 14. As described in more detail later, fuel is discharged through the frustro conical outlet 16 where it interfaces with high velocity air passing through channel 18 and swirled by swirler 20. Additional secondary air is introducted in a swirling manner through air passage 22 after being swirled by swirl vanes 24.

Figure 2:
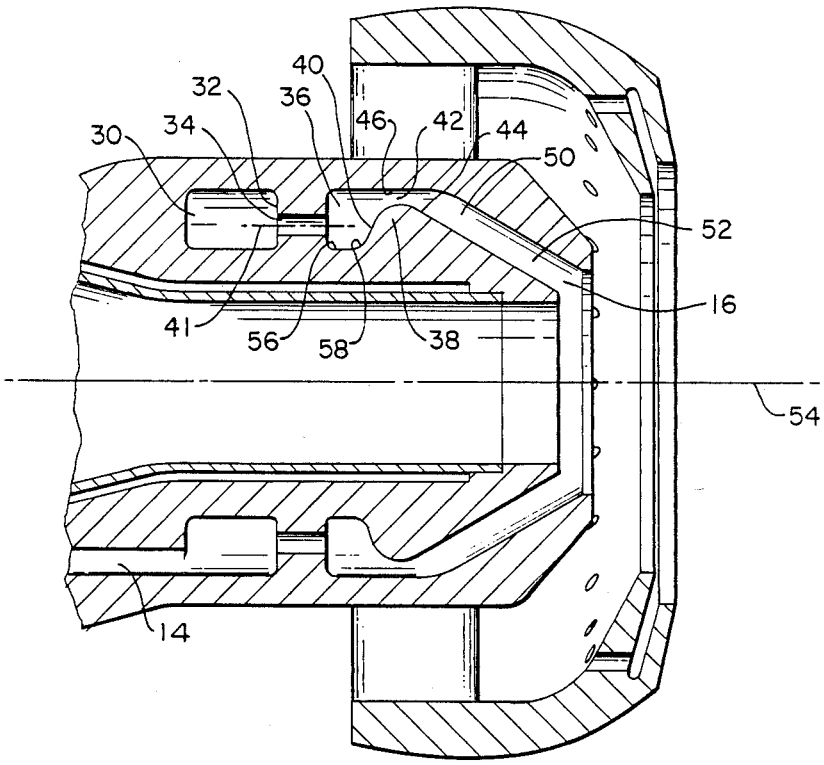
FIG. 2 is a detail sectional view showing the fuel flow path structure.

It is important that the fuel exiting from discharge 16 be uniformly distributed and to that end the relevant features of the invention are shown in the expanded view of FIG. 2.

Fuel is delivered from supply line 14 to an annular supply chamber 30 which permits circumferential distribution of the fuel. An annular plate 32 has a plurality of orifices 34 distributed circumferentially. These orifices are in parallel flow relationship with all being in fluid communication with supply chamber 30 as well as annular chamber 36 which is located downstream of the orifices.

At the downstream side of this annular chamber is a outwardly extending humped circumferential baffle 38 having an upstream outwardly facing surface 40. This surface is located directly in line with the orifices so that the flow through the orifices impinges on the surface. Accordingly, there is an immediate tendency to distribute the concentrated flow streams from the orifice discharge. It is preferable that this baffle be located a distance downstream of the orifices which is less than 1½ times the diameter of the orifices, as measured along the axis 41 of the orifice.

In order to achieve appropriate circumferential distribution of fuel on striking the baffle, the upstream facing surface 40 should form an impingement surface. The upstream facing surface 40 is at an angle of 75 degrees from axis 54 passing through the center of the nozzle, and preferably always between 70 and 90 degrees therefrom.

An annular flow restriction 42 is formed between the outside edge 44 of baffle 38 and the outer surrounding surface 46 of the flow path.

Immediately downstream of this annular restriction is an annular expansion flowpath 50 receiving flow from the restriction. The local flow concentrations which were initially distributed to some extent by impingement on the baffle are further diminished in concentration by passing through the annular restriction and the following expansion.

Following this expansion the fuel passes into an increasingly restricted flow area of frustro conical annulus 52 passing to discharge 16.

An initial uniform distribution of flow around the periphery is accomplished by orifices 34 with local variations being substantially diminished with the baffle, restriction and following expansion, while velocity is again substantially increased as it approaches the outlet.

It is preferred that orifices 34 be skewed at an angle with respect to axis 54 whereby the fuel has a swirling motion as it passes through the flow path.

The upstream surface 40 of the baffle is joined to the inside surface 56 of annular chamber 36 by a smooth radius 58. This avoids carbon build up within the nozzle during operation.

We claim:

1. A liquid fuel nozzle for a gas turbine engine comprising:

an annular plate with a plurality of circumferentially spaced orifices in parallel flow relationship;

means for delivering fuel to said plurality of orifices;

an annular chamber downstream of said orifices;

an outwardly extending humped circumferential baffle located on the downstream side of said annular chamber with the upstream surface of said baffle directly in line with said orifices, whereby flow through said orifices impinges on said surface;

an annular flow restriction between the outside edge of said baffle and an outer surrounding surface;

an annular expansion flowpath downstream of said flow restriction; and an increasingly restrictive flow frustro conical annulus of decreasing diameter to discharge located downstream of said expansion flowpath.

2. A liquid fuel nozzle as in claim 1:

said annular chamber having an axially extending circumferential surface at its minimum diameter; and the upstream surface of said baffle joined to said surface with a smooth radius.

3. A liquid fuel nozzle as in claim 2:

said orifices having a diameter; and said baffle located less than 1½ diameters downstream of said orifices.

4. A liquid fuel nozzle as in claim 3:

said fuel nozzle having a central axis; and said upstream surface forming an angle with respect to said axis of between 70 and 90 degrees.

5. A liquid fuel nozzle as in claim 1:

said orifices having a diameter; and said baffle located less than 1½ diameters downstream of said orifices.

6. A liquid fuel nozzle as in claim 5:

said fuel nozzle having a central axis; and said upstream surface forming an angle with respect to said axis of between 70 and 90 degrees.

7. A liquid fuel nozzle as in claim 1:

said fuel nozzle having a central axis; and said upstream surface forming an angle with respect to said axis of between 70 and 90 degrees.

* * * * *